US008801027B2

(12) United States Patent
Wollo et al.

(10) Patent No.: US 8,801,027 B2
(45) Date of Patent: Aug. 12, 2014

(54) FLEXOR WITH FASTENING CLIP

(75) Inventors: Even Wollo, Naersnes (NO); Thomas Holm, Oslo (NO); Oyvar Svendsen, Oslo (NO)

(73) Assignee: Rottefella AS, Klokkarstua (NO)

( * ) Notice: Subject to any disclaimer, the term of this patent is extended or adjusted under 35 U.S.C. 154(b) by 0 days.

(21) Appl. No.: 13/384,396

(22) PCT Filed: Jul. 17, 2009

(86) PCT No.: PCT/EP2009/059217
§ 371 (c)(1),
(2), (4) Date: Mar. 27, 2012

(87) PCT Pub. No.: WO2011/006544
PCT Pub. Date: Jan. 20, 2011

(65) Prior Publication Data
US 2012/0175860 A1 Jul. 12, 2012

(51) Int. Cl.
*A63C 9/00* (2012.01)

(52) U.S. Cl.
USPC ..... 280/633; 280/615; 280/636; 280/634

(58) Field of Classification Search
USPC ..... 280/631–634, 611, 615, 623, 625–627, 280/11.31, 636; 267/140.3, 141, 153, 267/140.2, 292; 248/615, 619, 621
See application file for complete search history.

(56) References Cited

U.S. PATENT DOCUMENTS

| | | | | |
|---|---|---|---|---|
| 5,114,172 | A * | 5/1992 | Rousset et al. | 280/633 |
| 5,228,714 | A * | 7/1993 | Dekanovsky | 280/615 |
| 5,338,053 | A * | 8/1994 | Hauglin | 280/615 |
| 6,027,135 | A * | 2/2000 | Hauglin | 280/615 |
| 6,402,184 | B1 * | 6/2002 | Hauglin | 280/615 |
| 2006/0065499 | A1 * | 3/2006 | Smaldone et al. | 188/372 |
| 2008/0129015 | A1 * | 6/2008 | Hauglin | 280/623 |

FOREIGN PATENT DOCUMENTS

| | | | | |
|---|---|---|---|---|
| DE | 4142390 | A1 * | 2/1993 | A63C 9/08 |
| DE | 299 21 023 | | 3/2000 | |
| DE | 29921023 | U1 * | 3/2000 | A63C 9/20 |
| EP | 2 135 645 | | 12/2009 | |
| FR | 2 634 132 | | 1/1990 | |
| FR | 2 738 158 | | 3/1997 | |

OTHER PUBLICATIONS

International Search Report for corresponding patent application No. PCT/EP2009/059217 dated May 4, 2010.

* cited by examiner

*Primary Examiner* — J. Allen Shriver, II
*Assistant Examiner* — Steve Clemmons
(74) *Attorney, Agent, or Firm* — Renner, Otto, Boisselle & Sklar, LLP

(57) ABSTRACT

The present invention relates to a multi-element flexor unit (1) for a ski binding (2), in particular a cross country or touring ski binding. The flexor unit (1) comprises: a flexor element (10) which is attached, attachable or integrally formed with a base element (30) for interaction and attachment with the ski binding (2) in a removeable manner. Further the base element (30) is provided with part of a snap-fit connector (31) for attaching the multi-element flexor unit (1) to the ski binding (2). Also disclosed is a ski binding (2) for housing the multi-element flexor unit (1).

15 Claims, 7 Drawing Sheets

(a)

(b)

(c)

(d)

(a)

(b)

(c)

(a)

(b)

(a)

(b)

FLEXOR WITH FASTENING CLIP

This application is a national phase of International Application No. PCT/EP2009/059217 filed Jul. 17, 2009 and published in the English language.

BACKGROUND TO THE INVENTION

Cross-country or touring skiing is a very popular winter sport enjoyed by many. As is generally well known in the art, the skier is connected to the ski in a rotatable manner, so as to allow the heel of the skier to break contact with the upper surface of the ski. This method of attachment between the skier and the ski is most commonly provided by means of a specialist ski boot, which has a pin providing the rotation axis for the skier's foot. The pin of the ski boot is usually attached to a ski binding, and is held in a rotatable manner.

In general, a cross-country ski binding will have a flexor or a return spring for inducing the ski boot back into the normal position, where the heel of the ski boot is in contact with the upper surface of the ski. Flexors can take a variety of different shapes and designs, and are typically constructed such that they will rotate or be compressed when the ski boot rotates and its heel is brought off the upper surface of the ski.

In order to change the flexor on a ski binding, it is usually necessary to return the binding to a ski outlet. Further, spring based flexors, or the like, require specialist tools in order to change the resistive force which they apply. Indeed, most flexors are extremely difficult to change, and in some cases form an integral part of the binding. For those people able to change the flexors themselves during skiing, a further significant problem arises as a result of the temperature when skiing. As will be obvious, the ski is usually used in temperatures around or below 0° C. At such temperatures, traditional compressible flexors become extremely rigid and inflexible, thus making it extremely difficult to remove the flexor from the ski binding, as it is very hard to compress such a flexor by hand. Further, for professional or semi-professional skiers, the flexor is designed to be extremely resilient, and even when warm, this can be extremely difficult to compress and remove from the ski binding.

In light of the above problems, the present disclosure relates to a user-oriented flexor which can readily be exchanged in a ski binding according to the desires of the skier or the snow conditions. In particular, the flexor can be changed without requiring additional tools or expertise, and further can even be changed in the outdoors and at cold temperatures.

SUMMARY OF THE INVENTION

The present invention provides a flexor unit in accordance with independent claim 1, as well as a ski binding for this flexor unit in independent claim 13. Further preferred embodiments are given in the dependent claims.

The claimed invention can be better understood in view of the embodiments of the flexor unit and ski binding described hereinafter. In general, the described embodiments describe preferred embodiments of the invention. The attentive reader will note, however, that some aspects of the described embodiments extend beyond the scope of the claims. To the respect that the described embodiments indeed extend beyond the scope of the claims, the described embodiments are to be considered supplementary background information and do not constitute definitions of the invention per se. This also holds for the subsequent "Brief Description of the Drawings" as well as the "Detailed Description."

In particular, the present disclosure relates to a flexor unit which comprises several elements, wherein the unit is designed for attaching to a ski binding. In particular, the ski binding will be a binding for either a cross-country or touring ski. The flexor unit may comprise both a flexor element and a base element, wherein the flexor element is either formed as an integral part of the base portion, or is attached, or attachable, thereto. For example, the flexor element could be fabricated with the base element, thus making an integral single unit. Alternatively, it is possible to fabricate the flexor element separate from the base element and attach the two elements together to make the flexor unit. Further, it is possible to make the base element in a first moulding step, and in a second moulding step to form the flexor element attached thereto. Clearly, the use of a two-step moulding process or fabrication process, will allow for the base element and flexor element to be structured from different materials, each material having the appropriate and desired properties.

The base element is designed such that it can removably interact and attach with a ski binding. In order to achieve this removable attachment, the base element may be provided with a part of a snap-fit connector which will interact with an appropriate point on the ski binding. The snap-fit connector can take many forms, although one possible example is that of a flexible strip which upon attachment of the flexor unit to the ski binding is bent or deformed, until the flexor unit is in its desired resting position. When the flexor unit is in this resting position, the flexible portion can snap back into its original un-flexed position and orientation, and a section of this connector can interact with the ski binding to stop detachment of the two. Clearly, bending the flexible strip or snap-fit connector of an attached flexor unit will thus allow the flexor unit to be brought out of its attached engagement, and the flexor unit may be readily removed from the ski binding.

In order to remove the above flexor unit from the ski binding, the flexor element is not directly involved. That is, the base element is what interacts with the ski binding, and it is this element which must be disengaged from the appropriate section on the ski binding. The flexor element need not be stressed or deformed in order to remove the flexor unit from the ski binding, which obviously greatly improves the ease with which the flexor, and obviously the flexor unit, can be interchanged. Further, if the base element is made from a rigid material which is generally cold resistant, even if the flexor unit is used in a skiing environment, it will still be relatively straightforward to actuate the snap-fit connector and remove the flexor unit from the ski binding.

The base element in the flexor unit may further be structured with an appropriate pin receiving portion. This pin receiving portion is ideally shaped and sized so as to receive at least a portion of the rotation pin of the ski boot, when the ski boot is attached to the ski binding. This allows for the flexor unit to appropriately align and interact with the ski boot of the skier, in order to allow appropriate use of the flexor elements.

It is further possible to provide the base element with a boot plate for providing a surface with which the boot of the skier interacts. The boot plate may be formed as an integral part of the base element, or could be an element which is attached to the base plate in a rotatable manner. Ideally, the boot plate is structured such that it will make direct contact with the under surface of a ski boot, when the ski boot is held in the ski binding comprising the flexor unit. That is, the relative position between the boot plate and the pin receiving portion may be such that when the rotation pin of the ski boot is in the pin receiving portion, the boot plate will be located in contact with the under side of the ski boot.

In addition to providing the snap-fit connector, perhaps by means of the deformable strip, the flexor unit may further comprise one or more wings in the base portion. In particular, these wing portions can extend laterally out of the lower side of the base portion, at an end of the flexor unit opposite that of the snap-fit connector. By providing the wings to the base portion, the flexor unit can be slidably engaged with the ski binding, with the wing portions interacting with flanges or slots provided in the ski binding. This will avoid the back end of the flexor unit from rotating along with the rotation of the ski boot. The wing portions will generally stop the back portion of the flexor unit from moving out of contact with the ski binding, thus securely holding the ski binding and flexor unit together.

As a further mechanism of attachment between the flexor unit and the ski binding, a clip may be provided on the underside of the base portion. Such a clip, or under-clip, could interact with an appropriate flange or bar present in the ski binding, thus providing a further connection between the flexor unit and ski. In particular, this under-clip could be useful for stopping accidental disengagement of the flexor unit when the ski is not in use.

The flexor element of the flexor unit may preferably be provided as a single piece unit, which comprises two portions. The front portion of the flexor may be separated from a rear portion of the flexor by means of a pin receiving slot. This pin receiving slot is sized and shaped to receive the rotation pin of the ski boot, whilst allowing rotation of the ski boot without a great deal of translational motion or wobble. It would be further advantageous for the pin receiving slot of the flexor element to align with the pin receiving portion of the base element, when the flexor element and base element are attached together to form the flexor unit. Provision of the pin receiving slot stops the accidental disengagement of the flexor element from the base element when the flexor unit is in use, as clearly the flexor element 10 will be held in place by means of the rotation pin of the ski boot. Further, when the rear flexor portion is attached to the front flexor portion, the full flexor element is kept in place by means of the rotation pin, which greatly reduces the chance of loss when skiing.

It is possible to form the front flexor portion as a flexor appropriate for classic style skiing. That is, the front flexor portion is structured so as to interact with the toe portion of a ski boot, and be compressed when the ski boot rotates out of contact with the upper surface of the ski. It is further possible to provide the rear flexor portion as an appropriate flexor for a skating style action with the ski. It is further possible for the flexor unit to be provided without this skating action flexor, in which case the rear portion is merely a flat non-protruding section of the flexor unit. By still providing the rear portion, even if this is non-protruding, the entire flexor unit is held in place by means of the pin receiving slot housing the rotation pin of the ski boot.

In order to improve the action of the ski binding and flexor unit, the front flexor portion may further be provided with a boot surface. This boot surface could be designed such that it will be in the appropriate position to allow direct contact with the under surface of the ski boot, when the ski boot is attached to the ski binding. Most preferably, the boot surface may be provided with first and second pre-tensioning surfaces, which are located and designed so as to appropriately match the contour of the lowest surface of the ski boot. In this way, the lower surface of the ski boot, when held in the ski binding, will be in direct contact with these two pre-tensioning surfaces, on both the lower side of the ski boot sole as well as the toe portion. In particular, it is preferable that the first and second pre-tensioning surfaces are at least 80% in contact with the under surface of the ski boot and the generally upward sloping toe portion of the ski boot, when the boot is attached to the binding.

The first and second pre-tensioning surfaces are preferably formed into an open "L" shape, so as to present a generally stepped front boot surface of the flexor portion. In particular, the first pre-tensioning surface could extend in a generally upward and forward direction, when taking the forward direction as being the skiing direction. The second pre-tensioning surface would then generally extend from the lowest point of the first pre-tensioning surface, or the joining point between the two surfaces, in a backward and downward direction. Obviously, the angle between these two pre-tensioning surfaces can be designed and chosen to match exactly, or approximately, that of the ski boot being used.

By providing two pre-tensioning surfaces to the flexor element, the operation of the flexor unit is greatly improved. Many skiers appreciate a pre-compression of the flexor when attaching the boot in its rest position to the ski binding; by increasing the amount of deformation of the flexor at attachment of the ski boot, the greater will be the immediate resistance to the rotation. Certain skiers will appreciate a greater resistance to the rotation of the ski boot for lower rotation angles, which is achieved by pre-stressing and compressing the flexor element. This compression can only proceed so far, however, as after a certain amount of compression the flexor will be virtually completely compressed; this dramatically restricts the rotation angle of the ski boot, as the interaction between the toe portion of the ski boot and the flexor will stop rotation of the ski boot.

By providing two pre-tensioning surfaces, however, it is possible to provide a more even compression of the flexor as a pre-tensioning or pre-stress, as the force acts both on a forward and downward surface of the flexor. That is, the flexor need not be completely compressed by a single surface of the ski boot, and thus the compression in a forward and downward direction by means of the two pre-tensioning surfaces, allows for less compression of the flexor to give an appropriate resistive force to the rotation of the ski boot, which will in turn be felt by the skier. Such a design allows for an increased level of resistance and return force acting on the ski boot, whilst also allowing for a greater angle of rotation of the ski boot with respect to the ski binding.

The flexor element can advantageously comprise a hole which would allow a boot plate of the base portion to pass there-through, in order to allow the boot plate to provide the surface for interaction with the underside of the ski boot. Obviously, if no boot plate is provided on the base portion, it is not necessary to provide a hole through the flexor element. It is further possible to provide a recess in the boot surface which would appropriately receive such a boot plate, if present, so that when the boot plate is within the recess, the outer face of the boot plate matches the outer surface of the boot surface. This would create and provide a smooth non-ridged combined surface, for receiving the underside of the ski boot.

A ski binding also forms part of the present disclosure, in particular a ski binding for a cross-country or touring ski. The ski binding may be structured in order to accommodate the above described flexor unit, in particular the snap-fit connector thereof. Advantageously, the ski binding may comprise a slot which will allow a snap-fit connector region of the flexor unit to slide therein and thus connect the flexor unit and the ski binding together. For example, a bridge piece could be provided around or over the slot such that the snap-fit connector is deformed as it passes under the bridge, until the flexor unit is in place. When the flexor unit is in place, the snap-fit connector snaps back to its original "at rest" orientation, and is held in place by means of the bridge on the ski binding. As is clear from this, the ski binding will readily allow for a flexor unit of the present disclosure to be slotted into engagement with the ski binding. Further, simple compression of the snap-fit connector of the flexor unit will allow this to pass underneath the bridge portion, and thus the flexor unit can be extracted from the ski binding.

It is additionally possible to provide the ski binding with one or more secondary slots for interacting with wing portions of the base elements, should these be provided. Such slots are obviously located further back in the ski binding than the first slot described above, and will allow the wing portions to slide therein when the flexor unit is in complete locking engagement with the ski binding. As has been described above, the wing portions and the second slots interact such that when the flexor unit is held within the ski binding, the one or more wing portions stop rotation of the flexor unit and help to keep this in place within the ski binding.

It is further possible to provide an under lock in the ski binding which could receive an under-clip from a base element. This under-lock can take a variety of different forms, from a simple flange to a separate pin which can be held on to by the under-clip of the base element. Not only would such a secondary lock increase the hold between the ski binding and the flexor unit, but this would also improve the hold between these two elements when the ski and binding is in transit.

The ski binding is preferably structured such that when the flexor unit is held in the ski binding, the pin receiving portion and pin receiving slot of the base element and flexor element, are appropriately aligned with the pin fastening means of the ski binding. That is, the ski binding will be provided with a fastening means for holding the rotation pin of the ski boot, and thus designing the ski binding to position all of the relevant pin receiving portions of the flexor element, base element and ski binding, will ensure that the ski boot is held in a rotational manner which will not allow relative lateral movement.

DETAILED DESCRIPTION

Figure 1:
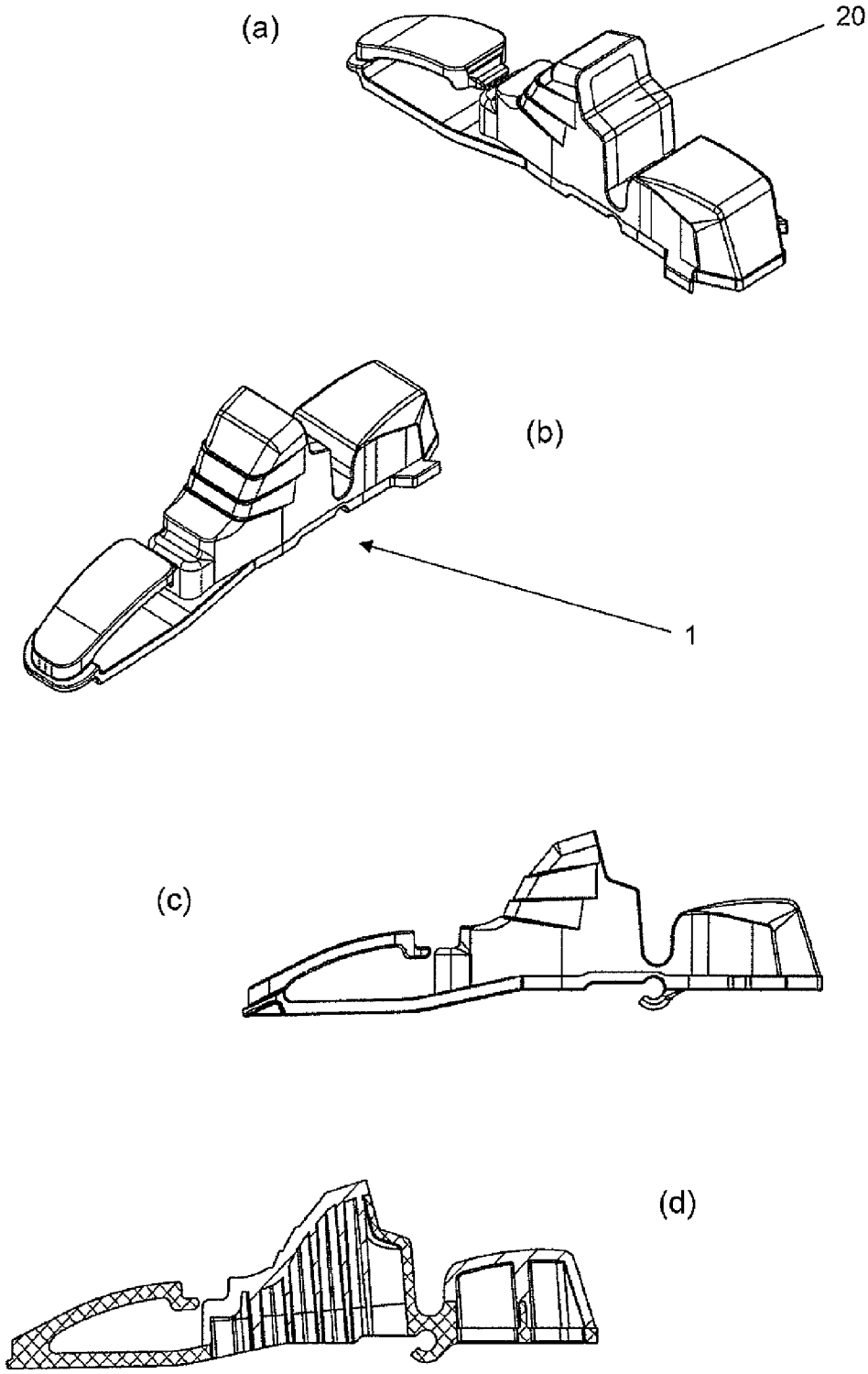
FIG. 1: This figure shows perspective and cross-sectional views of a multi-element flexor unit according to the present disclosure.
Figure 2:
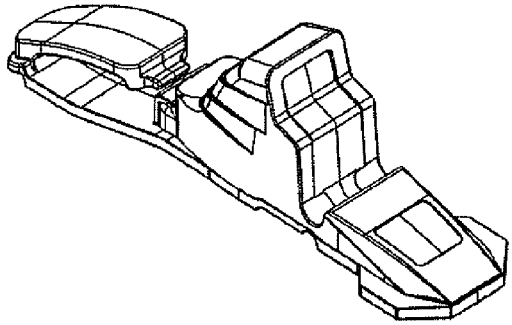
FIG. 2: This figure shows further views of a second possible option for the multi-element flexor unit of FIG. 1.
Figure 2:
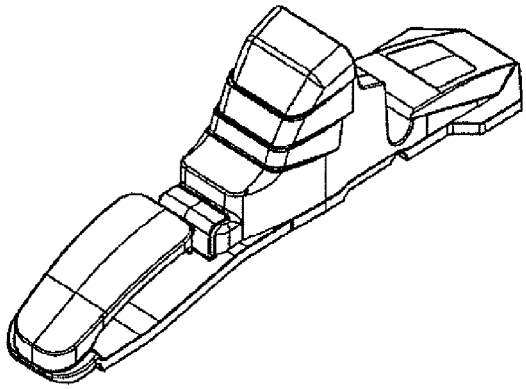
Figure 2:
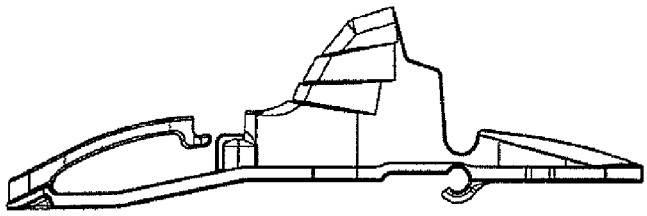
Figure 2:
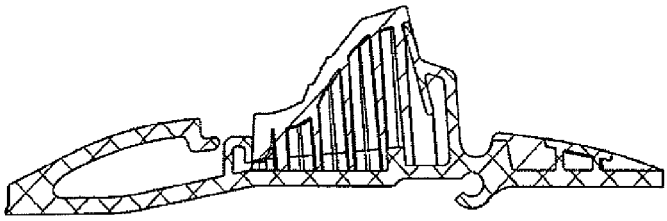

FIGS. 1 and 2 show two possible designs for a multi-element flexor unit 1. In particular the most striking difference between these two multi-element flexor units 1 are the shape of the flexor element 10. FIG. 1 shows a flexor element 10 which is suitable for both classic and skating skiing actions, whereas FIG. 2 is a multi-element flexor unit 1, more suited to only the classic skiing style. As is well known in the art, for classic skiing the ski boot of a skier will rotate around the rotation pin provided in the ski boot, and thus the toe portion of the ski boot will rotate forward. In order to provide a resistance to this rotation, as well as a return force acting on the boot to bring it back into contact with the ski upper surface, a flexor element 10 is typically provided in front of the ski boot. In FIGS. 1 and 2, the flexor element 10 comprises a front flexor portion 11 which is designed to meet the toe portion and underside of the ski boot, and thus resist the rotation of the ski boot and induce the ski boot to return to its normal rest position.

In a skating skiing action, a further flexor portion is required under the ball of the foot of the skier. FIG. 1 has a rear flexor portion 12 which is provided protruding generally upwards, and will thus be positioned underneath the ball of the skier's foot. As can be seen in FIG. 2, by contrast, the rear flexor portion 12 is not provided with a flexor protrusion, rather it is a generally planar element which would not be felt by the skier using such a flexor element 10. The flexor element 10 shown in FIGS. 1 and 2, can be more clearly seen in FIGS. 5 and 6, and will be described in further detail below.

The multi-element flexor units 1 of FIGS. 1 and 2 may comprise a base element 30 as well as the flexor elements 10. The multi-element flexor unit 1 may be comprised of these two separate sections, in order to improve the ease with which the multi-element flexor units 1 can be incorporated into a ski binding 2. The base elements 30 of FIGS. 1 and 2 are shown in FIGS. 3 and 4, without the flexor elements 10 attached thereto.

Figure 3:
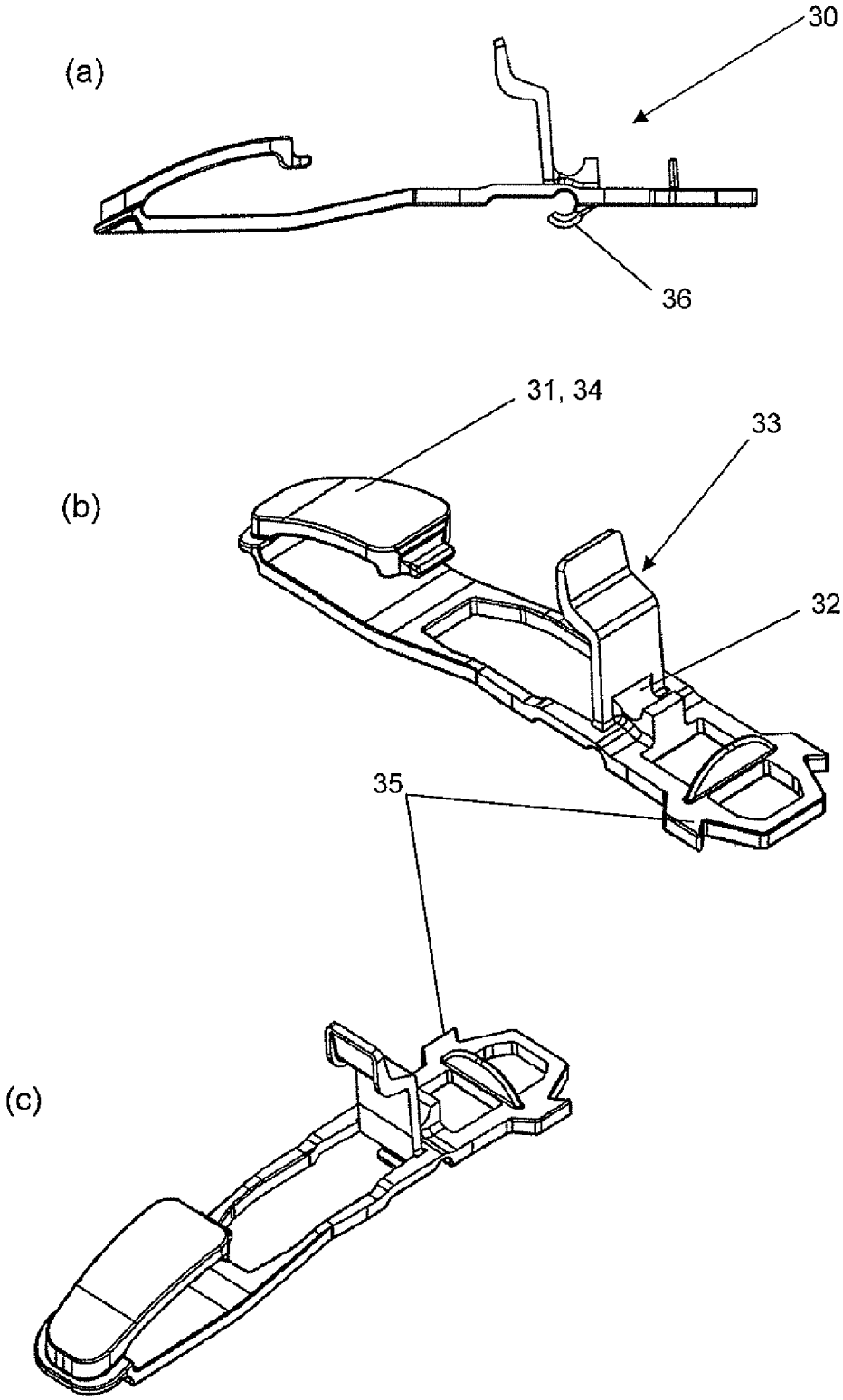
FIG. 3: This shows a variety of views of a base element for use in one of the flexor units in either FIG. 1 or 2.
Figure 4:
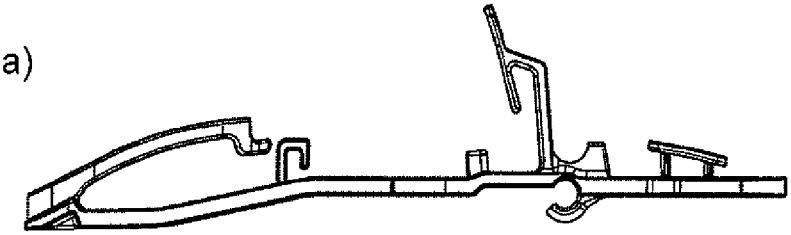
FIG. 4: Further views showing a different design for the base element for use in the flexor units of FIG. 1 or 2.
Figure 4:
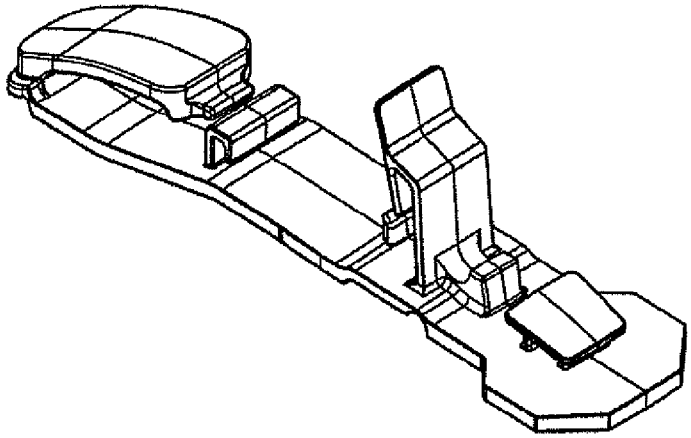
Figure 4:
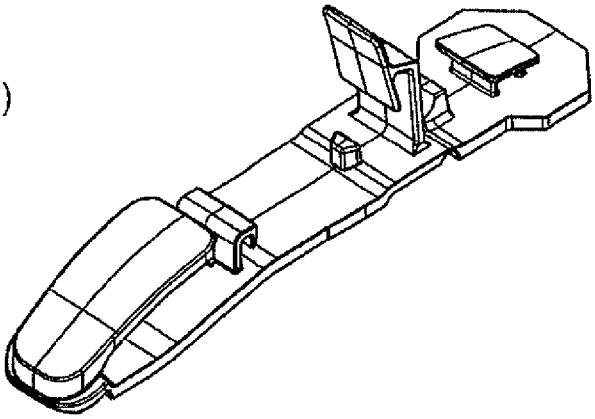

As can be seen in FIGS. 1(*c*) and (*d*), as well as FIGS. 2(*c*) and (*d*), and further in FIGS. 3 and 4, the base elements 30 may be provided to connect with the flexor elements 10. It is intended that the multi-element flexor unit 1 may either be composed of a separate flexor element 10 and base element 30 which are attached together (that is the flexor element 10 and base element 30 are manufactured separately and combined to form the multi-element flexor unit 1); or they could be double moulded into the multi-element flexor unit 1. Obviously, it is possible for the flexor element 10 and base element 30 to be comprised of different materials, each material being appropriately chosen for its respective task. Likewise, if so desired, the materials for the flexor element 10 and base element 30 could be the same.

As is seen in the figures, the base element 30 can be provided with part of a snap-fit connector 31; in particular, either the male or female half of such a connector. In the further text, the term "snap-fit connector 31" will be used to mean one half or part of such a connector, in particular as the snap-fit connector section on the base element 30 could take any form in order to interact with the matching other half or section on the ski binding 2, or the like. This snap-fit connector 31 is shown in the present designs as being a flexible strip 34 of material forming part of the base element 30. This flexible strip 34 may be an integral part of the base element 30, or could be a separate part which is attached to the remaining base element 30 in a rotatable manner.

The snap-fit connector 31 is provided so as to allow the multi-element flexor unit 1 to be connected to a ski binding 2 in a removable and simple manner. In particular, it will be clear that the designs shown in the figures would allow the multi-element flexor unit 1 to be slid into engagement with an appropriate section on the ski binding 2, wherein the snap-fit connector 31 would appropriately fix the multi-element flexor unit 1 into the ski binding 2. In the designs shown in the figures, the flexible strip 34 may be deformed upon engagement of the multi-element flexor unit 1 with the ski binding 2, until the multi-element flexor unit 1 is in its fully engaged position. Once the multi-element flexor unit 1 is its fully engaged position, the flexible strip 34 snaps back to its original shape, and holds the multi-element flexor unit 1 within the ski binding 2 by acting against an appropriate portion of the ski binding 2.

The snap-fit connector 31 could also be embodied as a rigid and hard section at the back end of the flexor 1. As will be appreciated, if a flexible element were to be provided in the ski binding 2, this could interact and hold the flexor element 10 in the ski binding 2 by snapping into place and stopping further motion of the flexor element 10. For example, if the flexor element 10 were to be slid into an appropriate section of the ski binding 2, it would be possible for this to deform a section of the ski binding 2 acting as part of a snap-fit connector 31. When the flexor element 10 were in its desired position, the part of the snap-fit connector 31 on the ski binding 2 would be positioned to snap back into place, and stop the sliding out of the flexor element 10. In this way, it would be necessary for the snap-fit connector 31 on the base element 30 to be resilient and hard to interact with the ski binding 2, in order that the flexor element 10 then would not deform.

The snap-fit connector 31 shown in the figures is one of a variety of designs, and it is the principle of providing the multi-element flexor unit 1 with the base element 30 and flexor element 10 that forms the basis for the present disclosure. That is, the base element 30 can be structured to comprise the snap-fit connector 31, in whatever form this may take, for holding the flexor element 10 into the ski binding 2. As is quite clear from this disclosure, the user of the ski binding 2 can readily swap the flexor element 10 in the ski binding 1, by simply swapping the multi-element flexor unit 1.

As has been discussed above, it is not uncommon for a skier to wish to change the flexor element 10 whilst on the snow. If the base element 30 is provided from a material which does not become unduly rigid in cold temperatures, it is clear that the multi-element flexor unit 1 can readily be swapped in the ski binding 2. That is, by actuation of the snap-fit connector 31, the multi-element flexor unit 1 can be changed, and the skier does not have to try and deform the flexor element 10. The flexor element 10 will typically be provided by a material which is quite resilient to the constant skiing action. Such materials are usually greatly affected by the temperature, and at temperatures associated with skiing will often become extremely resilient to any deformation. Attempting to deform and remove a flexor element 10 directly can prove extremely difficult in cold temperatures, as the flexor element 10 is extremely difficult to deform and remove from a ski binding 2.

It will be noted from FIGS. 3 and 4, that different mechanisms for attaching the flexor element 10 to the base element 30 are provided. In FIG. 3, for example, a hole is provided in a region of the base element 30 into which a section of the flexor element 10 can protrude, thus holding the flexor element 10 and base element 30 together. This protrusion into the hole can be seen in the cross-sectional drawing of FIG. 1(*d*). A further option would be to provide a series of hooks, and the like, in the upper surface of the base element 30, as shown in FIG. 4. Again, as seen in FIGS. 2(*c*) and (*d*), the flexor element 10 can then grip or be positioned under and around these hooks and flanges and the like, thus holding the flexor element 10 and the base element 30 together. It is clear that these two options are provided as examples only, and indeed the skilled person will be well aware that a great many techniques for connecting the flexor element 10 and the base element 30 together are known, and will be equally successful in providing the multi-element flexor unit 1.

As can be seen in FIGS. 3 and 4, the base element 30 is further provided with a boot plate 33. This boot plate 33 can be positioned very close to a pin receiving portion 32, which is intended to receive at least a section of the rotation pin of the ski boot. If the base element 30 is provided with this boot plate 33, the base element 30 can be so structured to locate the pin receiving portion 32 and the boot plate 33 in order to properly interact with the underside of the ski boot. Most ski boots are designed with an underside in which the rotation pin is provided in a recess near the toe portion of the ski boot. The boot plate 33 can be positioned relative to the pin receiving portion 32, such that when the rotation pin of the ski boot is within the pin receiving portion 32, the boot plate 33 is appropriately located to make good contact with the underside of the ski boot. As will be further discussed in relation to the flexor elements 10, the boot plate 33 can be designed so that a portion of this rests on the underside of the ski boot sole, and a second portion interacts with the toe portion of the ski boot.

The boot plate 33 is provided to give a good resilient surface upon which the ski boot can press during skiing. As will be clear, if the boot plate 33 is structured to appropriately mate with the underside of the ski boot, during rotation of the ski boot the boot plate 33 will merely be bent and would not translationally move with respect to the underside of the ski boot. This lack of relative motion between the ski boot and the boot plate 33 is advantageous, as it avoids any frictional loss and improves the efficiency of the skiing. As is further clear, the boot plate 33 will appropriately compress the flexor element 10 in order to give an even compression of the flexor element 10, as well as being useful for holding the flexor element 10 within the base element 30 to provide the multi-element flexor unit 1.

As can also be seen in the FIGS. 3 and 4, the base element 30 may be provided with wing portions 35. These wing portions 35 are located most preferably at the back end of the base element 30, this being defined as the opposite end to that housing the snap-fit connector 31. When the multi-element flexor unit 1 is held within a ski binding 2 and in use, rotational forces will be constantly acting on the multi-element flexor unit 1. By housing the multi-element flexor unit 1 in the ski binding 2 and holding this by means of the snap-fit connector 31, this would allow for the rotation of the ski boot to act to bring the back of the multi-element flexor unit 1 out of contact with the ski binding 2. Whilst a rigid material being chosen as the base element 30 will counteract this rotational lifting of the back of the multi-element flexor unit 1, it is also possible to provide wing portions 35. These wing portions 35 would appropriately attach to means provided in the ski binding 2, such that the back of the base element 30 were also held in good contact and fixed to the ski binding 2. Obviously, the positioning of the wing portions 35 at the back of the base element 30 is a preferred location, although the same advantage could be obtained by providing wing portions 35 along the entire length of the base element 30, or at least a part thereof.

A further method of attaching the base element 30, and also the multi-element flexor unit 1, to the ski binding 2, is shown in FIGS. 1 to 4 by means of an under clip 36. The under clip 36, if present, would provide a further means for attaching the multi-element flexor unit 1 to the ski binding 2. Clearly, such an under clip 36 could attach to an appropriate flange, bar, or the like in the ski binding 1, thus providing a further fixing point of the multi-element flexor unit 1 to the ski binding 2. If the under clip 36 is provided aligned with the pin receiving portion 32 of the base element 30, the rotation point of the boot with respect to the multi-element flexor unit 1 will also be more firmly held in the ski binding 2.

Figure 5:
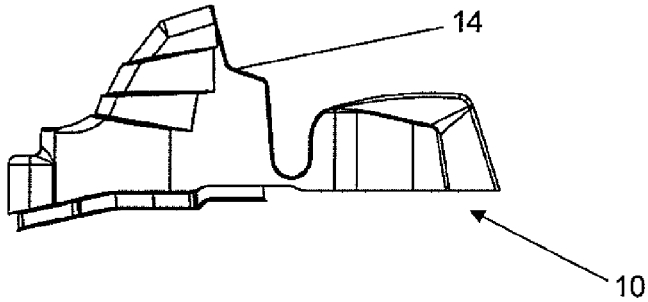
FIG. 5: Two views showing a flexor element which could be combined with the base element of either FIG. 3 or 4.
Figure 5:
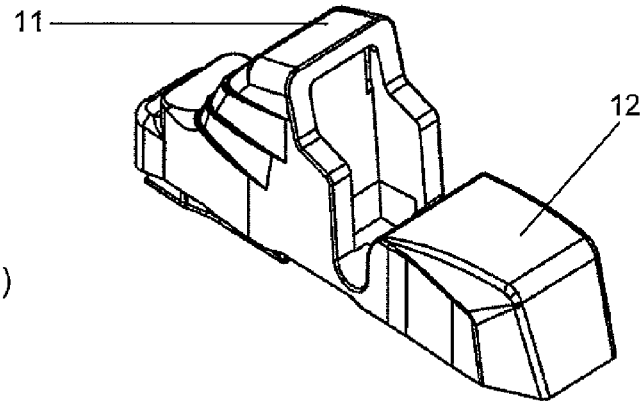
Figure 6:
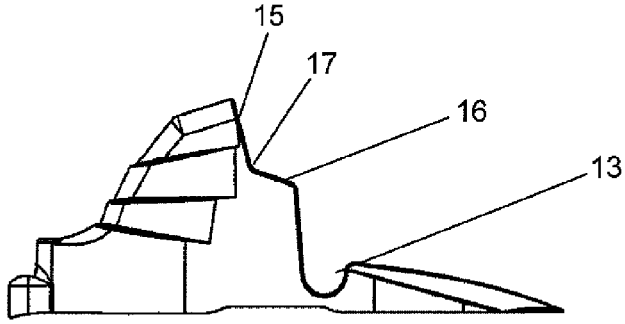
FIG. 6: A second flexor element which could be incorporated with the base elements of either FIG. 3 or 4.
Figure 6:
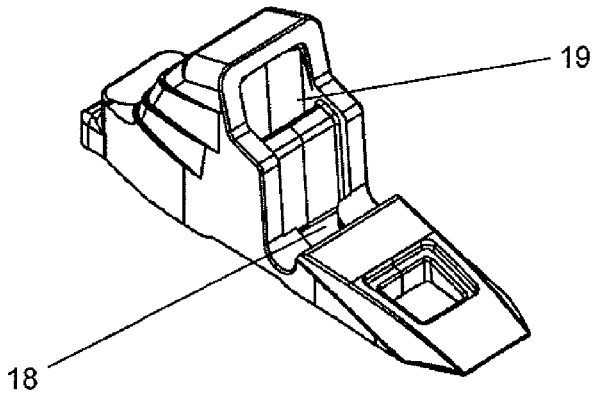

Turning to FIGS. 5 and 6, the designs for the flexor element 10 are more clearly seen. Whilst it appears that the flexor element 10 shown in FIG. 5 is more appropriate for the base element 30 shown in FIG. 1, this is purely by illustration. Clearly, the flexor elements 10 shown in either of FIGS. 5 and 6 could be housed in any of the base elements shown in FIGS. 1 to 4. As is evident from FIGS. 5 and 6, and as has been discussed above, the flexor elements 10 may be comprised of a front flexor portion 11 and a rear flexor portion 12. The directions: front and rear, coincide with the direction of travel of the ski. Located between the front 11 and rear 12 flexor portions, may be a pin receiving slot 13. This pin receiving slot 13 is designed to allow the rotation pin of the ski boot to be positioned therein, and further to allow appropriate rotation thereof.

The flexor element 10 can be designed as a single unit, wherein this single unit comprises the front 11 and rear 12 flexor portions. The provision of such a flexor element 10 is advantageous, as the ski boot positioned in the pin receiving slot 13 will tend to keep the flexor element 10 within the ski binding 2 during skiing. It is not uncommon for the use of a flexor in a ski binding to lead to loss or displacement of the flexor during use. By fixing the flexor element 10 of the present disclosure into the ski binding 2, by locating the rotation pin of the ski boot in the pin receiving slot 13, the flexor element 10 can appropriately be held in the ski binding 2.

As is further evident in FIGS. 5 and 6, the flexor elements 10 can be provided with a boot surface 14. As was discussed above with the boot plate 33 of the base element 30, the boot surface 14 can be a portion of the front flexor portion 11 upon which the boot of the skier will act during classic skiing. As is well known in the art, it is typical for the toe portion of the ski boot to compress a flexor in order to receive a return force moving the ski appropriately, with respect to the ski boot. In order to improve the action in the present case, the boot surface 14 may be structured such that when the ski boot is within the ski binding 2, the location and shape of the boot surface 14 with respect to the pin receiving slot 13 will cause the boot surface 14 to rest against both the underside and toe portion of the ski boot. By structuring the boot surface 14 of the flexor element 10 in such a manner, no relative translational motion between the lower surface and toe portion of the ski boot and the boot surface 14 will occur, thus improving the efficiency of the skiing action as no frictional loss will occur.

The boot surface 14 is advantageously provided with a first pre-tensioning surface 15 which is structured and located with respect to the pin receiving slot 13 such that it will rest on the front surface of the toe portion of the ski boot. A second pre-tensioning surface 16 may be formed at an angle to the first pre-tensioning surface 15, and is again structured and located such that this will make good contact to the underside of the ski boot. Indeed, the boot surface 14 may be structured such that when the ski boot is held within the ski binding 2, the first 15 and second 16 pre-tensioning surfaces are in complete contact with the toe portion and underside of the ski boot respectively. It is preferable, that the percentage of connection between these two be 80% or more of the surface of each of the first 15 and second 16 pre-tensioning surfaces. In particular, the joining point 17 between the first 15 and second 16 pre-tensioning surfaces of the boot surface 14, may coincide with the joining point between the underside of the ski boot and the toe portion of the ski boot.

A further advantage of structuring a boot surface 14 by means of first 15 and second 16 pre-tensioning surfaces which match the underside of the ski boot, is that of pre-tensioning or compressing of the flexor element 10 by positioning the boot into the ski binding 2. It is not uncommon for a skier to wish to increase the resistance with which a flexor acts against the rotation of a ski boot. Whilst it is possible to change the material of a flexor, this is an unreliable technique, as changing the material will also drastically affect the entire force versus compression curve of the flexor. When skiing, this can lead to a nearly incompressible flexor, in particular when the skiing conditions are particularly cold. It is not uncommon for standard flexors in ski bindings to be structured such that they are slightly compressed when the ski boot is attached to the ski binding 2. By positioning the surface of the flexor which is in direct contact with the toe portion of the ski boot higher and higher, it is clear that the flexor will be more compressed as the ski boot is positioned into the binding 2. Unfortunately, this is only good up until a certain point, as above certain conditions it is extremely difficult to actually position the ski boot within the ski binding 2, as the flexor actually blocks the route for the rotation pin of the ski boot to pass to the fixing mechanism. Further, if the required initial compression return force is extremely high, the flexor is almost completely compressed by the time the boot is in place, thus meaning that the maximum rotation of the ski boot is greatly reduced.

In order to address this issue, the boot surface 14 provided by the first 15 and second 16 pre-tensioning surfaces, allows for an increase in the pre-tensioning return force, without negatively impacting on the maximum rotation of the ski boot or drastically affecting the resistance force for ski boot rotation angle which can occur by changing the material of the flexor. As can be appreciated from the above discussion, when a ski boot is placed within the ski binding 2, the first 15 and second 16 pre-tensioning surfaces each act on the ski boot. Indeed, by positioning the first 15 and second 16 pre-tensioning surfaces appropriately, the entire flexor element 10 is compressed when a ski boot is fixed within the ski binding 2. Rather than only a single surface being compressed in normal flexor designs, the use of the two pre-tensioning surfaces 15, 16 means that the entire flexor element 10 is generally compressed and a greater resistive force can be generated for resisting the rotation of the ski boot. Further, by means of the compression of the flexor element 10 in this manner, the resistance can be increased, without causing the same difficulties in engaging the ski boot with the ski binding 2.

As is clear from the figures, the first pre-tensioning surface 15 may generally be provided extending upward and forward for interaction with the toe portion of the ski boot. The second pre-tensioning surface 16 may be provided generally extending downward and backward for interaction with the underside of the ski boot. These two pre-tensioning surfaces 15, 16 form an open L structure around the joining point 17. Changing the opening of the L for the two pre-tensioning surfaces 15, 16, will also change the amount of surface interacting with the underside of the ski boot, and can further change the initial rotation resistance amount and thus can be tailored for an individual skier.

Figure 8:
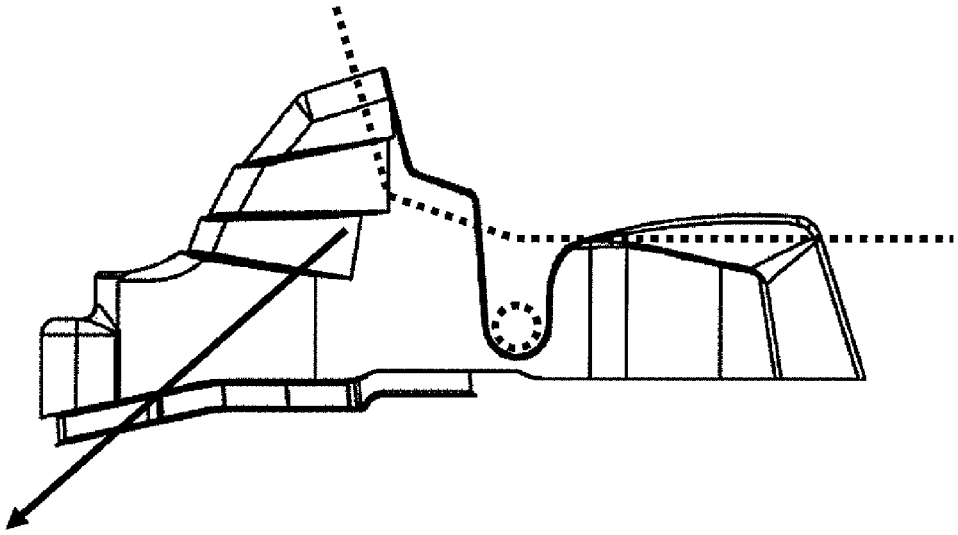
FIG. 8: Flexor showing an imaginary positioning of a boot when engaged with the flexor and ski binding (not shown).

FIG. 8 shows a schematic indication of how a ski boot would interact with the flexor element 10, and in particular the first 15 and second 16 pre-tensioning surfaces thereof. The grey dotted line indicates a general final resting point of the underside of a ski boot and the rotation pin thereof. This is not drawn to scale, and indeed the location of the boot at rest is likely to be less within the flexor element 10. Indeed, the location has been drawn somewhat exaggerated, so as to improve clarity. As can be seen from this figure, the lower surface of the ski boot will generally tend to cause the upper edge of the first pre-tensioning surface 15 to be bet round in an anti-clockwise direction. In addition to the rotation of a part of the flexor element 10, the second pre-tensioning surface 16 will generally be compressed be the downward action of the ski boot sole. The result of these two actions will tend to be a compression of the flexor element generally along the direction of the arrow shown in the figure. This general compression is much more controllable than simple rotation, and also allows for a better resistance to be generated without excessive amounts of deformation of the flexor element 10 being necessary.

In order to combine the flexor element 10 with the base element 30, the flexor element 10 can be provided with an appropriate extension for fitting in the hole of the base element 30, as shown in FIGS. 1, 3 and 5. Additionally, clips or recesses or the like can be provided in the flexor element 10, for attachment to appropriate clips in the base element 30; this is shown in FIGS. 2, 4 and 6. Further, if the base element 30 is provided with a boot plate 33, the flexor element 10 is appropriately provided with a hole 18. The hole 18 passes through the flexor element 10, and would allow the boot plate 33 to pass there-through. If, however, the multi-element flexor unit 1 is double moulded, it is clear that the flexor element 10 will be moulded around the pin receiving portion 32 and boot plate 33 in an appropriate manner, thus generating hole 18. Further, the flexor element 10 can have an appropriate recess 19 for housing the boot plate 33.

Again, the boot plate 33 could be provided with a variety of different shapes, and thus the recess 19 is also appropriately defined. If the flexor element 10 is separately produced, the hole 18 and recess 19 are positioned so as to interact with the pin receiving portion 32 and boot plate 33 of the base element 30. Clearly, if the multi-element flexor unit 1 is double moulded, the flexor element 10 will take on the appropriate shape for the base element 30, which will then comprise the hole 18 and recess 19.

As is clear from FIGS. 1 and 2, it is advantageous if the boot surface 14 has the same profile as the boot plate 33. This combination of the boot surface 14 and boot plate 33 will then present the combination surface 20, which will be a single surface comprised of the boot surface 14 and boot plate 33 for interaction with the ski boot. Again, the boot plate 33 will rotate with rotation of the ski boot, thus compressing the boot surface 14 and the flexor element 10.

As can be seen in FIGS. 1 and 2, it is possible to provide the flexor element 10 with cut-out portions in the front 11 and/or rear 12 flexor portions. The use of these cut-outs allow for tailoring of the compression versus force characteristics of the flexor element 10, in the multi-element flexor unit 1. By providing more cut-outs, the flexor element 10 may be more readily compressed, and likewise fewer cut-outs will lead to a less readily compressible flexor element 10. The use of such a flexor element 10 allows for a generally linear force versus compression for the flexor element 10, up until the point that all of the cut-outs are appropriately compressed. After this point, the material making up the flexor element 10 must be compressed, and thus a more exponential curve will be seen for the force versus compression of the flexor element 10.

Figure 7:
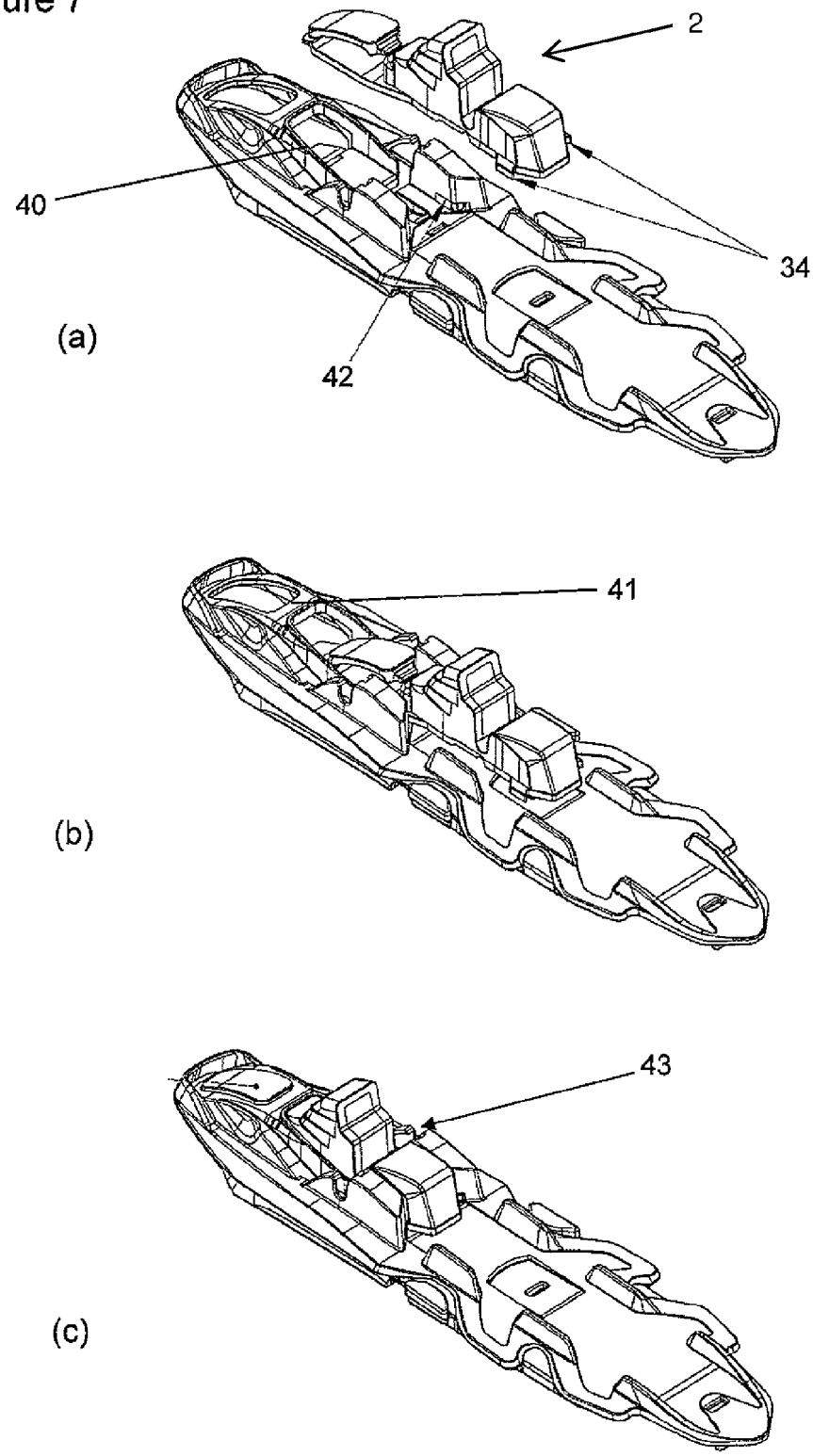
FIG. 7: A ski binding for use with the flexor unit of FIGS. 1 to 6, wherein the flexor unit is shown being mounted into the ski binding.

Turning to FIG. 7, we see a ski binding 2 which would be appropriate for attachment of the multi-element flexor unit 1 as discussed above. Firstly, the ski binding 2 may be provided with a first slot 40 into which the multi-element flexor unit 1 could be slidably engaged. In particular, the snap-fit connector 31 of the multi-element flexor unit 1 could pass through the first slot 40, and indeed could interact with bridge piece 41. The design of the snap-fit connector 31 shown in the above, is that of the flexible strip 34. As can be seen in the series of figures shown in FIG. 7, as the multi-element flexor unit 1 is slidably engaged into first slot 40, the flexible strip 34 is deformed until the multi-element flexor unit 1 is fully engaged in the ski binding 2. Once past the bridge piece 41, the flexible strip 34 returns back to its normal shape in a snap-fit manner, and thus holds the multi-element flexor unit 1 within the ski binding 2.

As has been discussed above, this is only one of a variety of well known snap-fit type connectors, and is shown by means of example only. For example, the base element 30 could be provided with two flexible arms either side of the base element 30, which would interact with two appropriate holes, slots or flanges in the ski binding 2. Upon sliding the multi-element flexor unit 1 within the ski binding 2, the two flexible arms would be compressed slightly until they fully engaged with the slots, at which point they would snap back into their normal shape and be held within the ski binding 2. Removal of the multi-element flexor unit 1 would then simply require stressing the flexible arms, until they could be passed through the slot in the ski binding 2 and out of the holes or flanges holding the ski binding 2 and multi-element flexor unit 1 together.

It is also possible to provide the ski binding 2 with a variety of second slots 42. These second slots 42 would be sized and positioned so as to interact with wing portions 35 on the base element 30, should these be present. By providing the one or more second slots 42 in the ski binding 2, the multi-element flexor unit 1 may be held at the front of the multi-element flexor unit 1 by means of the snap-fit connector 31, and further at the back of the multi-element flexor unit 1 by means of the wing portions 35 interacting with the one or more second slots 42. Further, should the base element 30 be provided with an under clip 36, it is evident that the ski binding 2 would also have an appropriate structure provided therein to interact therewith. For example, if the under clip 36 is a simple clip, as shown in FIGS. 1 to 4, the ski binding 2 may be provided with a flange or fastening bar in the surface for interacting with the under clip 36.

By provision of a ski binding 2 in such a manner, it is clear that the multi-element flexor unit can readily be slidably engaged and removed from the ski binding 2. It would also be possible and advantageous to ensure that the first slot 40 of the ski binding 2 would hold the multi-element flexor unit 1 in such a location that the pin receiving slot 13 and pin receiving portion 32 would align with pin fastening means 43 in the ski binding 2. The pin fastening means 43 of the ski binding 2 being an appropriate attachment means for affixing the rotation pin of the ski boot to the ski binding 2, in a rotational manner. A variety of different techniques and systems are known for pin fastenings 43, and the present disclosure is not intended to be limited to any of these.

Whilst the above disclosure has presented a variety of features relating to the multi-element flexor unit 1 and ski binding 2, these are not intended to be specifically limited to the above described combinations. Indeed, the present disclosure is intended to provide a variety of different features for each of these elements, which can be readily combined with other features. Primarily, the multi-element flexor unit 1 is characterised by providing a snap-fit connector 31 on a base element, and a single piece flexor element 10 which is appropriately formed around the base portion 30 and held in place by means of the rotation pin of the ski boot. Further, advantageously structuring the boot surface 14 and the boot plate 33 allows for good pre-tensioning and compression characteristics of the flexor element 10, without negatively impacting on the characteristics of the flexor in use.

| | |
|---|---|
| 1 | Multi-Element Flexor Unit |
| 2 | Ski Binding |
| 10 | Flexor Element |
| 11 | Front Flexor Portion |
| 12 | Rear Flexor Portion |
| 13 | Pin Receiving Slot |
| 14 | Boot Surface |
| 15 | First Pre-tensioning Surface |
| 16 | Second Pre-Tensioning Surface |
| 17 | Joining Point of 15 & 16 |
| 18 | Hole |
| 19 | Recess |
| 20 | Combination Surface |
| 30 | Base Element |
| 31 | Snap-fit Connector |
| 32 | Pin Receving Portion |
| 33 | Boot Plate |
| 34 | FlexibleStrip |
| 35 | Wing Portions |
| 36 | Under Clip |
| 40 | First Slot |
| 41 | Bridge Piece |
| 42 | Second Slot |
| 43 | Pin Fastening Means |

The invention claimed is:

1. A multi-element flexor unit for a ski binding, in particular a cross country or touring ski binding, comprising:

a flexor element which is attached, attachable or integrally formed with a base element for interaction and attachment with the ski binding in a removeable manner, wherein the base element is provided with part of a snap-fit connector for attaching the multi-element flexor unit to the ski binding, which is provided with the mating part of the snap-fit connector, the flexor element comprising a single piece double section element with a front flexor portion and a rear flexor portion, the flexor element further comprising a pin receiving slot between the front and rear flexor portions, the pin receiving slot being sized and shaped to receive a rotation pin of a ski boot, the front flexor portion being arranged to abut with a front underside portion of the ski boot when the ski boot is attached to the ski binding, and the rear flexor portion being arranged to abut with an underside portion of the ski boot behind the rotation pin when the ski boot is attached to the ski binding.

2. The multi-element flexor unit according to claim 1, wherein the base element further comprises a pin receiving portion which is sized and shaped to receive at least a part of a rotation pin of a ski boot; wherein the base element further comprises:

a boot plate which is rotationally attached or attachable, or formed as an integral part of the base element which is rotational with respect to the remaining parts of the base element, wherein the boot plate is located such that it will make contact with the underside of a ski boot when the ski boot is attached to a ski binding comprising the multi-element flexor unit.

3. The multi-element flexor unit according to claim 2, wherein a recess is provided in the boot surface to receive the boot plate such that the boot plate and the boot surface provide a uniform combination surface.

4. The multi-element flexor unit according to claim 1, wherein the part of the snap-fit connector comprises a flexible strip which can deform upon engagement with the ski binding and snaps back into place when the multi-element flexor unit is correctly in place to stop accidental disengagement, such that the multi-element flexor unit can be slidably engaged with the ski binding; and wherein the base portion comprises one or more wing portions which are located at the other end of the base portion to the snap-fit connector.

5. The multi-element flexor unit according to claim 1, wherein the base portion further comprises an under-clip located at the underside of the base portion for providing a further attachment point between the multi-element flexor unit and the ski binding.

6. The multi-element flexor unit according to claim 1, wherein the base portion is made from a material which is cold tolerant and which is still readily flexible at temperatures as low as −20° C.

7. The multi-element flexor unit according to claim 1, wherein the front flexor portion has a boot surface which is located such that the front underside portion of a ski boot will be in contact with it when the ski boot is attached to the ski binding.

8. The multi-element flexor unit according to claim 7, wherein the base element further comprises a boot plate which is rotationally attached or attachable, or formed as an integral part of the base element which is rotational with respect to the remaining parts of the base element, wherein the boot plate is located such that it will make contact with the underside of a ski boot when the ski boot is attached to a ski binding comprising the multi-element flexor unit, and wherein the flexor element comprises a hole through the flexor element to allow the boot plate to pass through when the flexor element is integrated with the base element.

9. The multi-element flexor unit according to claim 7, wherein the boot surface comprises first and second pre-tensioning surfaces which are structured to match the contour of the lower surface of the ski boot when attached to the ski binding such that the lower surface of the ski boot is in contact with each of the first and second pre-tensioning surfaces.

10. The multi-element flexor unit according to claim 9, wherein a plane of the first pre-tensioning surface extends generally upward and forward from the joining point of the first and second pre-tensioning surfaces, and the second pre-tensioning surface extends generally downward and backward from this joining point so as to create a boot surface which has an open L-shape.

11. The multi-element flexor unit according to claim 9, wherein the position of the boot surface, and the first and second pre-tensioning surfaces, with respect to the pin receiving slot, can be chosen to increase or decrease the amount of deformation of the entire front flexor portion which is required to allow a ski boot to be attached to a ski binding containing the multi-element flexor unit.

12. The multi-element flexor unit according to claim 1, wherein the flexor element and base element are one of:

a) independently fabricated and stuck together to form the multi-element flexor unit;

b) double moulded to form the multi-element flexor unit.

13. A ski binding which is structured to accommodate the multi-element flexor unit of claim 1, wherein the ski binding comprises a first slot which is sized to allow the snap-fit connector of the multi-element flexor unit to slide therein, and a bridge piece in the region of the first slot, wherein the bridge piece is located so as to interact with the snap-fit connector and hold the multi-element flexor unit in the ski binding.

14. The ski binding according to claim 13, further comprising:

one or more second slots which are sized and shaped to receive wing portions of the base element, if provided; and an under lock which is sized and shaped to receive an under clip of the base element, if provided.

15. The ski binding according to claim 13, wherein the first slot is positioned such that the multi-element flexor unit, when attached to the ski binding, will be located such that the pin receiving slot and the pin receiving portion will be aligned with pin fastening means on the ski binding, the pin fastening means being designed to attach the rotation pin of the ski boot to the ski binding.

* * * * *